US007118196B2

(12) United States Patent
Aoshima

(10) Patent No.: US 7,118,196 B2
(45) Date of Patent: Oct. 10, 2006

(54) INK JET RECORDING METHOD

(75) Inventor: Keitaro Aoshima, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 224 days.

(21) Appl. No.: 10/921,893

(22) Filed: Aug. 20, 2004

(65) Prior Publication Data

US 2005/0041067 A1 Feb. 24, 2005

(30) Foreign Application Priority Data

Aug. 22, 2003 (JP) ..... 2003-298505

(51) Int. Cl.
*B41J 2/06* (2006.01)

(52) U.S. Cl. ..... 347/55; 347/54

(58) Field of Classification Search ..... 347/54, 347/55, 103, 111, 112, 120, 123, 127, 128; 399/273, 290, 293–295
See application file for complete search history.

(56) References Cited

U.S. PATENT DOCUMENTS 3,949,410 A 4/1976 Bassous et al. ..... 347/75
4,314,263 A 2/1982 Carley ..... 347/48
5,754,199 A 5/1998 Miki et al. ..... 347/55
6,158,844 A * 12/2000 Murakami et al. ..... 347/55
6,908,177 B1 * 6/2005 Suganuma ..... 347/55
2002/0122099 A1 9/2002 Furukawa ..... 347/55

FOREIGN PATENT DOCUMENTS

EP 1 495 868 A1 1/2005
JP 10-138493 A 5/1998

OTHER PUBLICATIONS

Japanese Abstract No. 06222853, dated Aug. 12, 1994.
"Electrophotography-Bases and Applications", edited by The Imaging Society of Japan, and published by Corona Publishing Co., Ltd., pp. 497 to 505, 1988.

* cited by examiner

*Primary Examiner*—Juanita D. Stephens
(74) *Attorney, Agent, or Firm*—Sughrue Mion, PLLC

(57) ABSTRACT

When a drive frequency for an electrode used to cause an electrostatic force to act on an ink composition is assigned A, and a division frequency for a thread is assigned B, a relationship of A≧5 kHz and B/A≧5 is met, and a division frequency for the thread is reduced for a time period required to apply a pulse voltage to the electrode in order to eject the ink composition. As a result, it is possible to provide an electrostatic ink jet recording method with which excellent gradation controllability and controllability for dot diameters in a shadow area can be realized.

10 Claims, 4 Drawing Sheets

INK JET RECORDING METHOD

BACKGROUND OF THE INVENTION

The present invention relates to an electrostatic ink jet recording method for ejecting an ink composition by utilizing an electrostatic field.

In an electrostatic ink jet recording process, an ink composition (hereinafter, referred to as "ink") containing color fine particles charged with electricity in a dispersion medium is used, and predetermined voltages are respectively applied to ejection portions of an ink jet head in correspondence to image data, whereby the ink is ejected and controlled by utilizing electrostatic forces to record an image corresponding to the image data on a recording medium.

Known as an example of an electrostatic ink jet recorder is an ink jet recorder disclosed in JP 10-138493 A.

FIG. 4 is a schematic view showing an ink jet head of an electrostatic ink jet recorder disclosed in JP 10-138493 A.

The ink jet head 80 includes a head substrate 82, an ink guide 84, an insulating substrate 86, a control electrode 88, a counter electrode 90, a D.C. bias voltage source 92, and a pulse voltage source 94.

A nozzle (through hole) 96 through which ink is to be ejected is formed so as to extend perfectly through the insulating substrate 86. The head substrate 82 is provided so as to extend in a direction of disposition of the nozzles 96, and ink guides 84 are disposed in positions on the head substrate 82 corresponding to the through holes 96. The ink guide 84 extends perfectly through the nozzle 86 so as for its tip portion 84*a* to project upwardly and beyond a surface of the insulating substrate 86 on a side of a recording medium P.

The head substrate 82 is disposed at a predetermined distance from the insulating substrate 86. Thus, a passage 98 of an ink Q is defined between the head substrate 82 and the insulating substrate 86.

The ink Q containing fine particles (color fine particles) which are charged at the same polarity as that of a voltage applied to the control electrode 88 is made to circulate through the ink passage 98 from the right-hand side to the left-hand side in the figure, for example, by a circulation mechanism for ink (not shown). Thus, the ink Q is supplied to the corresponding ones of the nozzles 96.

The control electrode 88 is provided in a ring-like shape on the surface of the insulating substrate 86 on the side of the recording medium P so as to surround the periphery of the through hole 96. In addition, the control electrode 88 is connected to the pulse voltage source 94 for generating a pulse voltage in correspondence to image data. The pulse voltage source 94 is grounded through the D.C. bias voltage source 92.

In addition, the recording medium P is held on the insulating layer 92 of the grounded electrode substrate 90 with the recording medium P being charged at a high voltage opposite in polarity to that applied to the control electrode by a charger utilizing the scorotron charger or the like. Consequently, in this system, the recording medium P functions as a counter electrode, and the high voltage applied to the recording medium P becomes a bias voltage.

In such an electrostatic ink jet recording process, in a state where no voltage is applied to the control electrode 88, the Coulomb's attractive forces between the bias voltage applied to the counter electrode 90 and the charged particles (color fine particles) in the ink, the viscosity of the ink (dispersion medium), the surface tension, the resiliencies between the charged particles, the fluid pressure when the ink is supplied, and the like operate in conjunction with one another. Thus, the balance is obtained among these factors in a state where as shown in FIG. 4, the ink Q has a meniscus shape of slightly rising from the nozzle 96.

In addition, the charged particles migrate to move to the meniscus surface due to the Coulomb's attractive forces or the like, i.e., there is provided a state where the ink Q is concentrated on the meniscus surface.

When the voltage is applied to the control electrode 88, the bias voltage is superposed on the drive voltage so that the ink Q is attracted towards a side of the recording medium P (counter electrode) P to form a nearly conical shape, i.e., a so-called Taylor cone.

When a time elapses after application of the voltage to the control electrode, the balance between the Coulomb's attractive forces acting on the charged fine particles and the surface tension of the dispersion medium is broken. As a result, there is formed a slender ink liquid column having a diameter of about several microns to several tens of microns which is called a thread. When a time further elapses, a tip portion of the thread is divided, and as a result, droplets of the ink Q are ejected to fly towards the recording medium P by the electrostatic attraction force.

In the electrostatic ink jet recording process, normally, a modulated pulse voltage is applied to the corresponding ones of the control electrodes 88 to turn ON/OFF the corresponding ones of the control electrodes 88 to modulate and eject ink droplets. Thus, the ink droplets are ejected on demand in correspondence to a recording image.

Hence, the division of the thread is caused at a frequency much higher than the drive frequency for the pulse voltage used to eject the ink droplets. That is, the division of the thread is continuously caused multiple times for a time period required to apply a pulse voltage to the corresponding ones of the control electrodes once. Consequently, one dot on the recording medium P is formed with a plurality of minute droplets which were separately ejected.

In the electrostatic ink jet recording process, this process is utilized. That is, as described in U.S. Pat. No. 4,314,263, a time period required to apply a pulse voltage once (so-called pulse width) is controlled to thereby adjust the quantity of ejected minute droplets (the number of minute droplets) forming one dot. As a result, the uniformity of dot diameters on the recording medium P can be enhanced, and also the promotion of high gradation in the image recording can be realized by carrying out the control or the like for concentration and gradation utilizing the intentional adjustment of the dot diameters.

When the control for the image recording based on such an electrostatic ink jet recording process is carried out, if an area on the recording medium P is an area hot requiring high concentration so much, the control can be suitably carried out.

However, for a high concentration area called a shadow, a pulse voltage with a long pulse width is applied to the corresponding ones of the control electrodes 88 to eject the large quantity of ink onto the recording medium P. For this reason, the controllability for the gradation and the controllability for the dot diameters are reduced in the shadow area. That is, in the image recording based on the above-mentioned electrostatic ink jet recording process, though there are merits in high image quality, high gradation and the like, a problem occurs in that the controllability and the gradation reproducibility in the shadow area are poor.

SUMMARY OF THE INVENTION

The present invention has been made in order to solve the above-mentioned problems associated with the related art, and it is, therefore, an object of the present invention to provide an electrostatic ink jet recording method which is capable of enhancing the electrical controllability for ejection of ink droplets using a simple pulse control made by an inexpensive drive circuit, and which is capable of enhancing the gradation reproducibility and the uniformity of dot diameters in a shadow area to record an image of high image quality.

In order to attain the above-mentioned object, a first aspect of the present invention provides an ink jet recording method comprising the steps of: causing an electrostatic force to act on ink composition obtained by dispersing charged particles containing colorants in a dispersion medium; generating a thread of the ink composition on a nozzle; and dividing the thread into ink droplets to eject the ink droplets of the composition through the nozzle; wherein a relationship of $A \geqq 5$ kHz and $B/A \geqq 5$ is met when a drive frequency for an electrode used to cause the electrostatic force to act on the ink composition is assigned A, and a division frequency for the thread is assigned B; and the division frequency for the thread is reduced for a time period to apply a pulse voltage to the electrode to eject the ink composition.

It is preferable that the ink composition having electric conductivity of 10 to 3,000 pS/cm is used to reduce the division frequency.

It is preferable that electric field having strength of $1\times10^5$ to $3\times10^7$ V/m is applied to the electrode for the time period required to apply the pulse voltage to reduce the division frequency.

It is preferable that the ink composition is supplied to the nozzle at a rate of $1\times10^{-6}$ to $1\times10^{-3}$ cc/sec to reduce the division frequency.

It is preferable that the time period required to apply the pulse voltage to the electrode is controlled so as to adjust a quantity of ejection of the ink droplets of the ink composition in forming one dot on a recording medium.

It is preferable that a degree of reduction in the division frequency for the time period required to apply the pulse voltage to the electrode is equal to or larger than 5%.

In order to attain the above-mentioned object, a second aspect of the present invention provides an ink jet recording method comprising the steps of: causing an electrostatic force to act on ink composition obtained by dispersing charged particles containing colorants in a dispersion medium; generating a thread of the ink composition on a nozzle; and dividing the thread into ink droplets to eject the ink droplets of the composition through the nozzle; wherein the ink composition having an electric conductivity of 10 to 3,000 pS/cm is used; electric field having strength of $1\times10^5$ to $3\times10^7$ V/m is applied to the thread; and the ink composition is supplied to the nozzle at a rate of $1\times10^{-6}$ to $1\times10^{-3}$ cc/sec.

It is preferable that a pulse voltage is applied to an electrode used to cause the electrostatic force to act on the ink, a division frequency for the thread is reduced for a time period required to apply the pulse voltage to the electrode.

It is preferable that the time period required to apply the pulse voltage to the electrode is controlled so as to adjust a quantity of ejection of the ink droplets of the ink composition in forming one dot on a recording medium.

It is preferable that a degree of reduction in the division-frequency for the time period required to apply the pulse voltage to the electrode is equal to or larger than 5%.

According to the present invention having the above-mentioned constitution, in the electrostatic ink jet recording process, the electrical controllability for ejection of the ink droplet can be enhanced on the basis of the simple control for the pulse voltage using an inexpensive drive circuit. Also, the promotion of the high gradation, and the uniformity of the dot diameters can be realized by controlling the time period required to apply the pulse voltage (pulse width). Moreover, the gradation reproducibility and the uniformity of the dot diameters in the shadow area can be enhanced to record an image of high image quality.

This application claims priority on Japanese patent application No. 2003-298505, the entire contents of which are hereby incorporated by reference.

DETAILED DESCRIPTION OF THE INVENTION

An ink jet recording method of the present invention will hereinafter be described in detail on the basis of a preferred embodiment shown in the accompanying drawings.

Figure 1A:
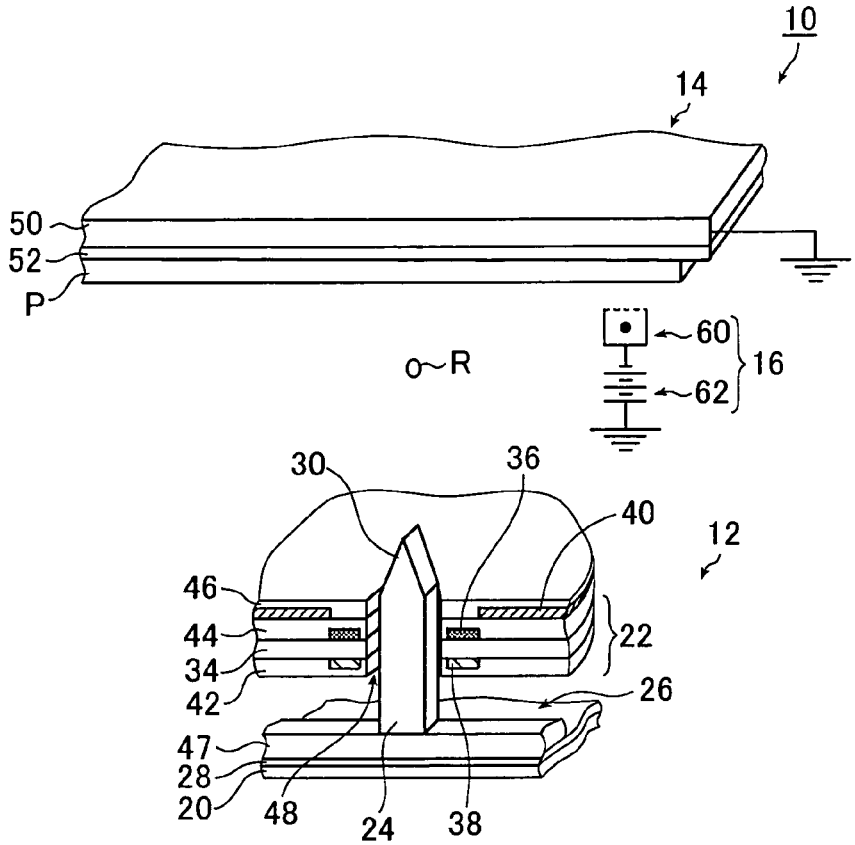
FIGS. 1A and 1B are conceptual views of an example of an ink jet recording apparatus for implementing an ink jet recording method of the present invention.
Figure 1B:
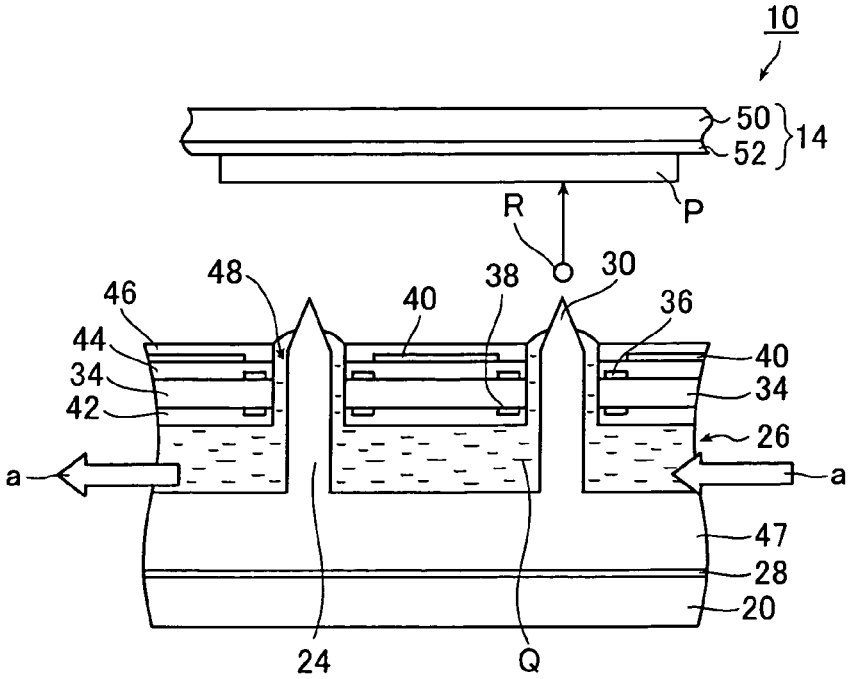

FIGS. 1A and 1B show conceptually an example of an electrostatic ink jet recording apparatus for implementing an ink jet recording method of the present invention. Note that in FIGS. 1A and 1B, FIG. 1A is a (partial cross sectional) perspective view, and FIG. 1B is a partial cross sectional view.

Figure 2A:
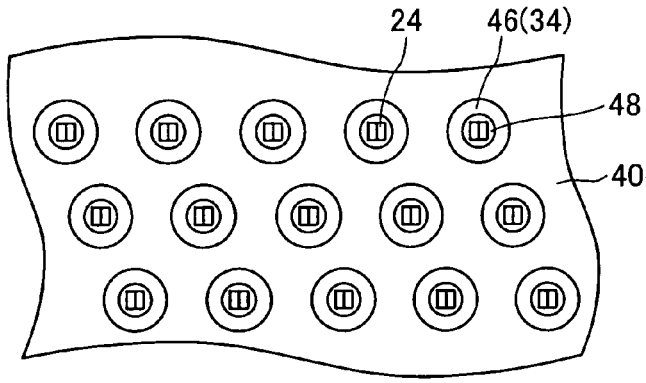
FIGS. 2A to 2C are conceptual views explaining control electrodes of the ink jet recording apparatus shown in FIGS. 1A and 1B.
Figure 2B:
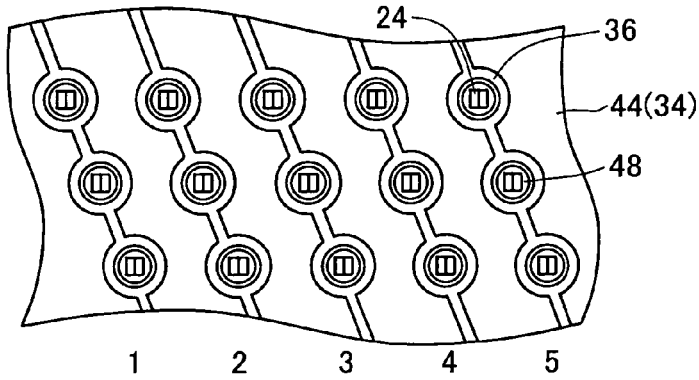
Figure 2C:
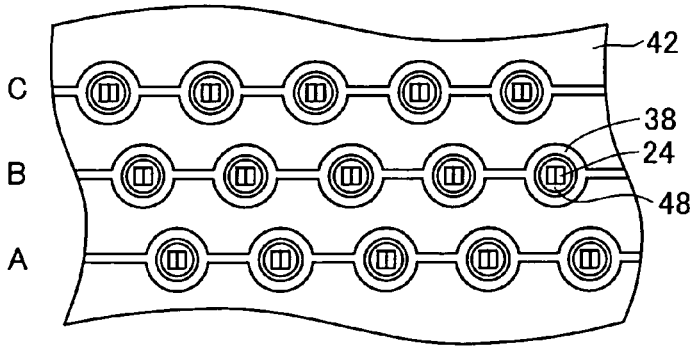

Note that in order to simplify the description, only one ejection portion of an ink jet head having a multi-channel structure in which as shown in FIGS. 2A to 2C, a large number of ejection portions are two-dimensionally disposed is shown in FIG. 1A, and only two ejection portions of the ink jet head are shown in FIG. 1B.

An ink jet recording apparatus (hereinafter referred to as "recording apparatus") 10 shown in FIGS. 1A and 1B includes an ink jet head (hereinafter referred to as "head") 12, holding means 14 for a recording medium P, and a charging unit 16. In this recording apparatus 10, the recording medium P is charged at a bias electric potential by the charging unit 16. Thereafter, the head 12 and the holding means 14 are relatively moved with the head 12 facing the recording medium P, and the corresponding ones of the ejection portions (control electrodes) of the head 12 are modulated and driven in correspondence to a recording image to be turned ON/OFF to eject an ink droplet R on demand. Thus, an objective image is recorded on the recording medium P.

The head 12 is an electrostatic ink jet head for causing the ink Q which is obtained by dispersing charged particles (charged color fine particles) containing a colorant into a carrier liquid to eject in the form of an ink droplet R by applying an electrostatic force. The head 12 includes a head substrate 20, a nozzle substrate 22, and ink guides 24.

The head substrate 20 is disposed opposed to each other at a predetermined distance from the nozzle substrate 22. Then, the ink passage 26 through which the ink Q is supplied to each ejection opening is defined between the head substrate 20 and the nozzle substrate 22. The ink Q, while its details will be described later, contains the color fine particles which are charged at the same polarity as that of the control voltages applied to first and second control electrodes 36 and 38. In recording an image, the ink Q is made to circulate through the ink passage 26 in a predetermined direction and at a predetermined velocity (e.g., at an ink flow of 200 mm/s).

The head substrate 20 is a sheet-like insulating substrate common to all the ejection portions, and a floating conductive plate 28 which is electrically in a floating state is formed on a surface of the head substrate 20.

In the floating conductive plate 28, an induced voltage is generated in recording an image. The induced voltage is induced in correspondence to voltage values of control voltages applied to control electrodes for the ejection portions as will be described later are. In addition, a voltage value of the induced voltage automatically changes in correspondence to the number of operating channels. The charged color fine particles contained in the ink Q within the ink passage 26 are energized by the induced voltage to migrate to a side of the nozzle substrate 22. That is, the ink of a nozzle (meniscus) 48 as will be described later is more suitable concentrated.

Note that the floating conductive plate 28 is not an essential constituent element, and hence is preferably provided suitably as may be necessary. In addition, the floating conductive plate 28 has to be disposed on the head substrate 20 side with respect to the ink passage 26. For example, the floating conductive plate 28 may be disposed inside the head substrate 20. Also, the floating conductive plate 28 is preferably disposed on an upstream side of the ink passage 26 with respect to a position where the ejection portion is disposed. Also, a predetermined voltage may be applied to the floating conductive plate 28.

On the other hand, the nozzle substrate 22, similarly to the head substrate 20, is a sheet-like insulating substrate common to all the ejection portions. The nozzle substrate 22 includes an insulating substrate 34, first control electrodes 36, second control electrodes 38, a guard electrode 40, and insulating layers 42, 44, and 46. In addition, nozzles 48 becoming ejection openings for the ink Q are formed in positions of the nozzle substrate 22 corresponding to the respective ink jet guides 24 so as to extend completely through the nozzle substrate 22.

As described above, the head substrate 20 is disposed at the predetermined distance from the nozzle substrate 22, and thus the ink passage 26 is defined between the head substrate 20 and the nozzle substrate 22.

The first and second control electrodes 36 and 38 are circular electrodes which are provided in ring-like shapes each on an upper surface and a lower surface of the insulating substrate 34 in the figures so as to surround the periphery of the nozzles 48 of each of the ejection portions. The upper surface of the insulating substrate 34 and a surface of the first control electrode 36 are covered with an insulating layer 44 for protecting these surfaces to obtain a flattened surface. Similarly, the lower surface of the insulating substrate 35 and a surface of the second control electrode 38 are covered with an insulating layer 42 for protecting these surfaces to obtain a flattened surface.

Note that neither of the first and second control electrodes 36 and 38 is limited to the ring-like circular electrode, and hence an electrode having any shape such as a nearly circular electrode, a sprit circular electrode, a parallel electrode, or a nearly parallel electrode may be adopted for each of the first and second control electrodes 36 and 38 as long as the electrode is disposed so as to face the ink guide 24.

As shown in FIG. 2A, the ejection portions each including the ink guide 24, the first and second control electrodes 36 and 38, the nozzle 48 and the like are two-dimensionally disposed in matrix in the head 12.

As shown in FIG. 2C, the head 12 has the ejection portions of three rows (corresponding to a row A, a row B, and a row C) which are disposed in a column direction (in a main scanning direction). Note that the five ejection portions (corresponding to a first column, a second column, a third column, a fourth column, and a fifth column) per row in a row direction (in a sub scanning direction), i.e., fifteen ejection portions in total which are disposed in matrix are shown in FIGS. 2A to 2C (refer to FIG. 2B).

As shown in FIG. 2B, the first control electrodes 36 of ejection portions which are disposed in the same column are connected to one another. In addition, as shown in FIG. 2C, the second control electrodes 38 of the ejection portions which are disposed in the same row are connected to one another.

Moreover, while its illustration is omitted here, the first and second control electrodes 36 and 38 are connected to pulse power supplies for outputting pulse voltages (drive voltage) used to eject the ink droplets R (used to drive the control electrodes), respectively.

The ejection portions belonging to a corresponding one of the rows are disposed at predetermined intervals in the row direction.

Also, the ejection portions belonging to the row B are disposed at a predetermined distance from the ejection portions belonging to the row A in the column direction, and are also disposed between the ejection portions belonging to the row A and the ejection portions belonging to the row C in the row direction. Similarly, the ejection portions belonging to the row C are disposed at a predetermined distance from the five ejection portions belonging to the row B in the column direction, and are also disposed between the five ejection portions belonging to the row B and the ejection portions belonging to the row A in the row direction.

In such a manner, the ejection portions contained in each of the row A, the row B, and the row C are disposed so as to be shifted in the row direction, respectively, whereby one row which is recorded on the recording medium P is divided into three parts in the row direction.

In recording an image, the first control electrodes 36 disposed in the same column are simultaneously pulse-driven at the same voltage level. Similarly, 5 second control electrodes 38 disposed in the same row are simultaneously pulse-driven at the same voltage level.

In addition, one row recorded on the recording medium P is divided into three groups corresponding to the numbers of rows of the second control electrodes 38 in the row direction to be successively recorded in a time division manner. For example, in a case of the example shown in FIGS. 2A to 2C, the row A, the row B, and the row C of the second control electrodes 38 are driven (turned on) at a predetermined timing to thereby obtain a state capable of recording an image for one row on the recording medium P. In synchronous with this, the first control electrodes 36 are pulse-modulation-driven in correspondence to the image data (recording image) and the ON/OFF of the ejection of the ink droplets R is switched, thereby recording the image.

Consequently, in the illustrated example, the image is recorded while the recording medium P and the head 12 are relatively moved in the column direction (in the main scanning direction), whereby the image can be recorded with a recording density 3 times as dose as that which each row has in the row direction (in the sub scanning direction).

Note that the structure of the control electrodes is not limited to the two-layer electrode structure having the first and second control electrodes 36 and 38, and hence a single-layer electrode structure or a three or more-layer electrode structure may also be adopted for the control electrodes.

The guard electrode 40 is a sheet-like electrode common to all the ejection portions, and, as shown in FIG. 2A, has ring-like opening portions which are formed in positions corresponding to the first and second control electrodes 36 and 38 which are formed in the peripheries of the nozzles 48 of each of the ejection portions. Then, the surface of the insulating layer 44 and an upper surface of the guard electrode 40 are covered with the insulating layer 46 for protecting these surfaces to obtain a flattened surface. A predetermined voltage is applied to the guard electrode 40 and hence it plays a function of suppressing an electric field interference generated between the ink guides 24 of the adjacent ejection portions.

Note that the guard electrode 40 is not an essential constituent element. In addition, in order to shield a repulsion electric field in a direction from the first control electrodes 36 or the second control electrodes 38 to the ink passage 26, the nozzle substrate 22 may be provided with a shielding electrode which is formed on a side of the ink passage 26 with respect to the second control electrode 38.

The ink guide 24 is a flat plate which is made of ceramics having a predetermined thickness and which has a convex tip portion 30. As the illustrated example, the ink guides 24 of the ejection portions in the same row are disposed at the predetermined intervals on the same supporting body 47 disposed on the floating conductive plate 28 on the head substrate 20. The ink guide 24 extends through the nozzle 48 bored through the nozzle substrate 22, and its tip portion 30 projects upwardly from the uppermost surface of the nozzle substrate 22 on the recording medium P side (corresponding to the upper surface of the insulating layer 46 in the figure).

The ink guide tip portion 30 is formed into nearly a triangle (or a trapezoid) which tapers off towards the holding means 14 for the recording medium P.

Note that a metal material is preferably evaporated onto the ink guide tip portion (the highest tip portion) 30. The evaporation of the metal material onto the ink guide tip portion 30 is not an essential factor. However, the evaporation of the metal offers an effect that a permittivity of the ink guide tip portion 30 substantially increases to facilitate the generation of a strong electric field.

Note that the shape of the ink guide 24 is not especially limited as long as the charged color fine particles contained in the ink Q can be made to migrate (that is, the ink Q is concentrated) toward the tip portion 30. For example, the ink guide tip portion 30 does not necessarily have the convex shape. Thus, the tip portion 30 may be freely changed. In addition, in order to promote the concentration of the charged fine particles, a cutout serving as an ink guide groove through which the ink Q is collected at the ink guide tip portion 30 by the capillary phenomenon may be formed vertically at the central portion of the ink guide 24 in the figure.

Note that such a head 12 may also be a so-called line head which has a column of ejection portions corresponding to full one side of the recording medium P, or may also be a so-called shuttle type head for which the scanning of the head 12 is combined with the intermittent conveyance of the recording medium P.

The holding means 14 for the recording medium P includes an electrode substrate 50 and an insulating sheet 52. The holding means 14 is disposed at a predetermined distance (e.g., at a distance of 200 to 1,000 μm) from the tip portion 30 of the ink guide 24 so as to-face the head 12.

The electrode substrate 50 is grounded, and the insulating sheet 52 is formed on a surface of the electrode substrate 50 on the ink guide 24 side. In recording an image, the recording medium P is held on the surface of the insulating sheet 52, i.e., the holding means (the insulating sheet 52) 14 functions as the platen of the recording medium P.

The charging unit 16 includes a scorotron charger 60 for charging the recording medium P at a negative high voltage, and a bias voltage source 62 for supplying a negative high voltage to the scorotron charger 60.

The scorotron charger 60 is disposed in a position facing the surface of the recording medium P at a predetermined distance from the surface of the recording medium P. In addition, a negative side terminal of the bias voltage source 62 is connected to the scorotron charger 60, and a positive side terminal of the bias voltage source 62 is grounded.

Note that the charging means of the charging unit 16 is not limited to the scorotron charger 60, and thus it is possible to use various conventionally known charging means such as a corotron charger and a solid charger.

In recording an image, the surface of the insulating sheet 52, i.e., the recording medium P held thereon is charged at a predetermined negative high voltage opposite in polarity to the high voltage applied to the first control electrode 36 or the second control electrode 38, e.g., at −1,500 V by the charging unit 16. As a result, the recording medium P is usually biased at a negative high voltage as compared with the first control electrode 36 or the second control electrode 38 and hence is electrostatically adsorbed on the insulating sheet 52 on the holding means 14.

That is, in the recording apparatus 10 in the illustrated example, the recording medium P functions as the counter electrode in the electrostatic ink jet recording process.

Note that while in the illustrated example, the holding means 14 is constituted by the electrode substrate 50 and the insulating sheet 52, and the recording medium P is charged at the negative high voltage by the charging unit 16 to be electrostatically adsorbed on the surface of the insulating sheet 52, the present invention is not limited to this constituent. That is, there may be adopted a constitution that the holding means 14 is constituted by only the electrode substrate 50, the holding means (the electrode substrate 50 itself) 14 is connected to the bias voltage source 62 to be usually biased at a negative high voltage and under this condition, the recording medium P is electrostatically adsorbed on the surface of the counter electrode.

In addition, the electrostatic adsorption of the recording medium P on the holding means 14, and the application of a negative high bias voltage to the recording medium P, or the application of a negative high bias voltage to the holding means 14 may also be carried out using different negative high voltage sources. Also, the means for supporting the recording medium P by the holding means 14 is not limited to the electrostatic adsorption of the recording medium P, and hence any other suitable supporting method or support means may also be used for the recording medium P.

Next, a description will hereinafter be given with respect to the ink Q used in the recording apparatus 10.

An ink composition in which charged fine particles containing (at least) a colorant (charged color fine particles) each having a particle diameter of about 0.1 to 5 μm are dispersed into a carrier liquid (dispersion medium) is used as the ink Q. Note that the ink Q may suitably contain dispersion resin particles for enhancing the fixing property of an image after printing.

In addition, the carrier liquid is preferably a dielectric liquid (nonaqueous solvent) having a high electrical resistivity (equal to or larger than $10^9\Omega\cdot$cm, preferably equal to or larger than $10^{10}\Omega\cdot$cm, and preferably equal to or smaller than $10^{16}\Omega\cdot$cm).

When the dielectric liquid having a high electrical resistivity is used as the carrier liquid, it is possible to reduce that the carrier liquid itself suffers the injection of the electric charges due to the applied voltage to the control electrode, and hence it is possible to concentrate the charged particles. In addition, the carrier liquid having a high electrical resistivity may contribute to the prevention of the electrical conduction between the adjacent ejection portions. Also, when the ink containing the carrier liquid having the electrical resistivity falling within the above-mentioned range is used, the ink can be satisfactorily ejected even in a low electric field.

In addition, a relative permittivity of the carrier liquid is preferably equal to or smaller than 5, more preferably equal to or smaller than 4, and much more preferably equal to or smaller than 3.5. Its lower limit is desirably about 1.9. Such a range is selected for the relative permittivity of the carrier liquid, whereby the electric field effectively acts on the charged particles in the carrier liquid to cause the charged particles to be easy to migrate. As a result, the polarization of the solvent can be suppressed to allow relaxation of the electric field to be suppressed. Thus, it is possible to form a dot which is less in bleeding and which has satisfactory image concentration.

As for the carrier liquid, preferably, it is possible to use straight chain or branch chain aliphatic hydrocarbon and alicyclic hydrocarbon, aromatic hydrocarbon, a halogen substitution product of these hydrocarbons, and the like.

More specifically, as the carrier liquid, for example, it is possible to singly or mixedly use hexane, heptane, octane, isooctane, decane, isodecane, decalin, nonane, dodecane, isododecane, cyclohexane, cyclooctane, cyclodecane, benzene, toluene, xylene, mesitylene, isopar C, isopar E, isopar G, isopar H, isopar L, isopar M (isopar: a trade name of a liquid material made by EXXON MOBILE CORPORATION), shellsol 70, shellsol 71 (shellsol: a trade name of a liquid material made by SHELL OIL CO., LTD.), amsco OMS solvent, amsco 460 solvent (amsco: a trade name of a liquid material made by SPIRITS CO., LTD.), silicone oil (e.g., KF-96L made by SHIN-ETSU CHEMICAL CO., LTD.) or the like.

As an example, the ink Q can be prepared so that the color fine particles are dispersed into a carrier liquid (dielectric liquid), and a charging control agent is added to the resultant carrier liquid to charge the color fine particles with electricity to thereby obtain the charged color fine particles.

With respect to the color particles, the colorant may be directly dispersed into a dielectric liquid, or may be indirectly dispersed into a dielectric liquid after being contained in disperse resin particles for enhancement of fixing property.

When the dispersion resin particles are added, in a case where the colorants are pigments, in general, there is adopted a method or the like in which the colorants are coated with the dispersion resin particles (resin material) to obtain the color fine particles coated with the resin material. On the other hand, in a case where the colorants are dyes, in general, there is adopted a method or the like in which the dispersion resin particles are colored with the colorants to obtain the color fine particles.

In addition, a content of color particles preferably falls within a range of 0.5 to 30 weight % for the overall ink Q from the viewpoint of concentration of the printed image, formation of uniform disperse liquid, and suppression of clogging of the ink in the heads, more preferably falls within a range of 1.5 to 25 weight %, and much more preferably falls within a range of 3 to 20 weight %.

Any material may be used as the colorants as long as this material is any one of an ink composition for ink jet recording, an (oiliness) ink composition for printing, and pigments and dyes which have been conventionally used for a liquid developer or the like for electrostatic photography.

A pigment which is generally used in the technical field of the printing may be used as the pigment used as the colorant, irrespective of whether the pigment is an inorganic pigment or an organic pigment.

More specifically, various conventionally known pigments such as carbon black, cadmium red, molybdenum red, chromium yellow, cadmium yellow, titanium yellow, chromium oxide, viridian, cobalt green, ultramarine blue, prussian blue, cobalt blue, azo series pigments, phthalocyanine series pigments, quinacridone series pigments, isoindolinone series pigments, dioxazin series pigments, vat pigments, perylene series pigments, perynone series pigments, thioindigo series pigments, quinophthalone series pigments, and a metallic complex pigment can be used as the pigment used as the colorant without being especially limited.

In addition, preferable examples of the dye used as the colorant include oil soluble dyes such as an azo dye, a metal complex dye, a naphthol dye, an anthraquinone dye, an indigo dye, a carbonium dye, a quinonimine dye, a xanthene dye, an aniline dye, a quinoline dye, a nitro dye, a nitroso dye, a benzoquinone dye, a naphthoquinone dye, a phthalocyanine dye, and a metal phthalocyanine dye.

Also, an average particle diameter of the color particles is not particularly limited, but preferably falls within a range of 0.1 to 5 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA LTD.).

After the color fine particles are dispersed into the carrier liquid, the charging control agent is added to the resultant carrier liquid to thereby charge the color fine particles with electricity. In such a manner, there is obtained the ink Q in which the charged color fine particles are dispersed into the carrier liquid. Note that in dispersing the color fine particles into the carrier liquid, a dispersion medium may be added if necessary.

As an example, any one of various charge control agents used in a liquid developer for electrostatic photography can be used as the charge control agent. More specifically, various charge control agents described in publications such as: "DEVELOPMENT AND PRACTICAL APPLICATION OF RECENT ELECTRONIC PHOTOGRAPH DEVELOP- ING SYSTEM AND TONER MATERIALS", pp. 139 to 148; "ELECTROPHOTOGRAPHY—BASES AND APPLICATIONS", edited by THE IMAGING SOCIETY OF JAPAN, and published by CORONA PUBLISHING CO., LTD., pp 497 to 505, 1988; and "ELECTRONIC PHOTOGRAPHY", by Yuji Harasaki, 16(No. 2), p.44, 1977 can be used.

It should be noted that the charged color fine particles may be charged with either positive or negative as long as the charged color fine particles are identical in polarity to the control voltages applied to the corresponding ones of the first control electrodes 36 and the corresponding ones of the second control electrodes 38 (the control electrodes for ejection of the ink), respectively.

In addition, a charging amount of the charged color fine particles is preferably in a range of 5 to 200 μC/g, more preferably in a range of 10 to 150 μC/g, and much more preferably in a range of 15 to 100 μC/g.

The electrical resistance of the carrier liquid is changed by adding the charging control agent in some cases. Thus, a distribution factor P defined below is preferably equal to or larger than 50%, more preferably equal to or larger than 60%, and much more preferably equal to or larger than 70%. The use of such ink Q facilitates migration of charged color particles and facilitates concentration of the ink.

$$P=100\times(\sigma 1-\sigma 2)/\sigma 1$$

where σ1 is an electric conductivity of an ink composition, and σ2 is an electric conductivity of a supernatant liquid which is obtained by inspecting the ink composition with a centrifugal separator.

Those electric conductivities were obtained by measuring the electric conductivities of the ink composition and the supernatant liquid under conditions of an applied voltage of 5 V and a frequency of 1 kHz using an LCR meter of an AG-4311 type (manufactured by ANDO ELECTRIC CO., LTD.) and electrodes for liquids of an LP-05 type (manufactured by KAWAGUCHI ELECTRIC WORKS, CO., JP). In addition, the centrifugation was carried out for 30 minutes under conditions of a rotational speed of 14,500 rpm and a temperature of 23° C. using a miniature high speed cooling centrifugal machine of an SRX-201 type (manufactured by TOMY SEIKO CO., LTD.).

As described later in detail, in the present invention, the electric conductivity of the ink Q (ink composition) to be used is preferably in a range of 10 to 3,000 pS/cm. The range of the electric conductivity as described above is set, resulting in that the applied voltages to the control electrodes are not excessively high, and also there is no anxiety to cause the electrical conduction between the adjacent recording electrodes. In addition, the frequency at which a thread is divided in one application of a pulse voltage described later can be suitably reduced.

In addition, the viscosity of the ink Q preferably falls within a range of 0.5 to 5 mPa·sec, more preferably falls within a range of 0.6 to 3.0 mPa·sec, and much more preferably falls within a range of 0.7 to 2.0 mPa·sec.

Moreover, a surface tension of the ink Q is preferably in a range of 15 to 50 mN/m, more preferably in a range of 15.5 to 45 mN/m, and much more preferably in a range of 16 to 40 mN/m. The surface tension is set to this range, resulting in that the applied voltages to the control electrodes are not excessively high, and also the ink does not leak and spread to the periphery of the head to contaminate the head.

An electrostatic ink jet recording method of the present invention will hereinafter be described in detail on the basis of an explanation of the operation for ejection of the ink droplet R in the recording apparatus 10.

Note that in the following example, the charged color fine particles dispersed into the ink Q are charged positive, and hence the positive voltages are applied to the corresponding ones of the first control electrodes 36 and the corresponding ones of the second control electrodes 38, respectively, and also the recording medium P is charged with a negative bias voltage in order to eject the ink droplet R.

In recording an image, the ink Q is made to circulate through the ink passage 26 from the right-hand side to the left-hand side in FIG. 1B (in a direction indicated by an arrow a in FIG. 1B) at a predetermined velocity by a circulation mechanism for ink (not shown).

On the other hand, the recording medium P is charged at a negative high voltage (e.g., at −1,500 V) by the charging unit 16, and is carried to an inner portion side of the paper in FIGS. 1A and 1B at a predetermined velocity by carry means (not shown) while being electrostatically adsorbed on the insulating sheet 52 on the holding means 14.

Figure 3A:
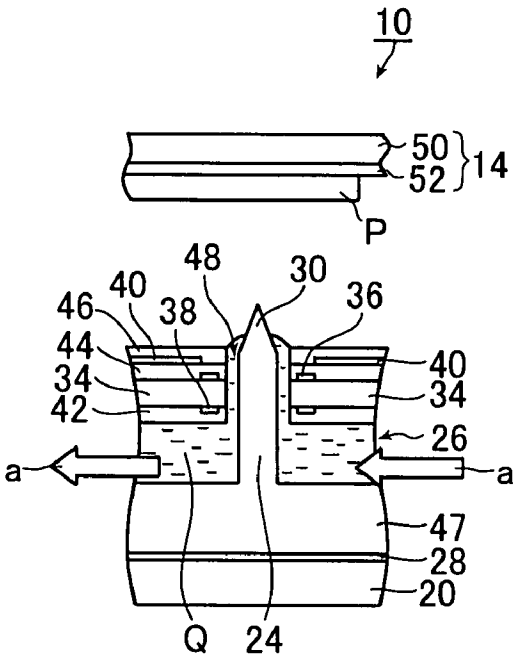
FIGS. 3A to 3C are conceptual views explaining the ink jet recording method of the present invention.

In the state in which only the bias voltage is applied to the recording medium P, the Coulomb's attractive forces between the bias voltage and the electric charges of the charged color fine particles of the ink Q, the Coulomb's resiliencies among the charged color fine particles, the viscosity of the carrier liquid, the surface tension, the dielectric polarization force and the like act on the ink Q, and these factors operate in conjunction with one another to move the charged color fine particles and the carrier liquid. Thus, as conceptually shown in FIG. 3A, the ink Q shows the meniscus shape in which the ink Q slightly rises from the nozzle 48 to thereby obtain the balance.

In addition, the Coulomb's attractive forces and the like move the charged color fine particles towards the recording medium P charged at the bias voltage through a so-called electrophoresis process. That is, the ink Q is concentrated at the meniscus of the nozzle 48.

Under this state, pulse voltages used to eject the ink droplet R are applied. That is, in the illustrated example, the pulse voltages (drive voltages) each falling within a range of about 400 to 600 V are applied from the corresponding pulse power supplies to the first and second control electrodes 36 and 38, respectively (ejection is valid).

Figure 3B:
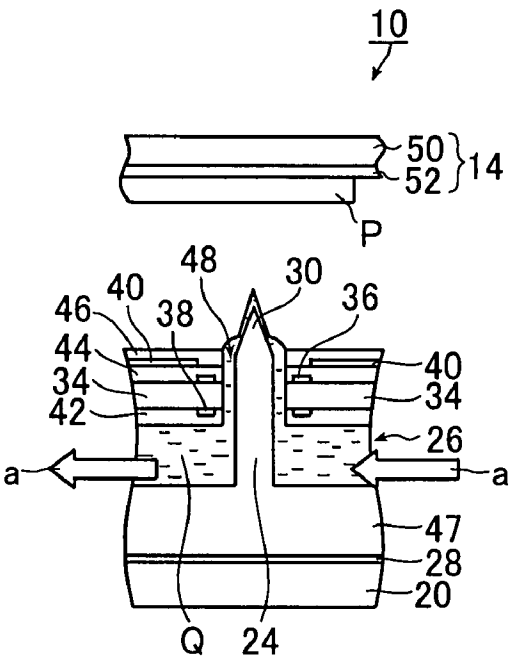

As a result, the drive voltage is superposed on the bias voltage, and hence the motion occurs in which the previous conjunction motion operates in conjunction with the superposition of the drive voltage. Thus, the charged color fine particles and the carrier liquid are drawn towards the bias voltage side (the counter electrode side), i.e., the recording medium P side through the electrophoresis process. As a result, as conceptually shown in FIG. 3B, the meniscus grows to form a nearly conical ink liquid column, i.e., the so-called Taylor cone from the tip portion of the meniscus. In addition, similarly to the foregoing, the charged color fine particles are moved to the meniscus surface through the electrophoresis process so that the ink Q at the meniscus is concentrated to show a nearly uniform high concentration state in which the ink Q at the meniscus has a large number of charged color fine particles.

Figure 3C:
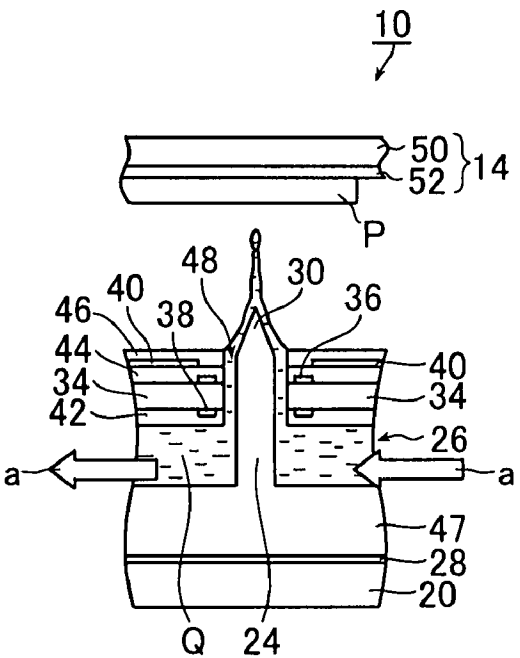
Figure 4:
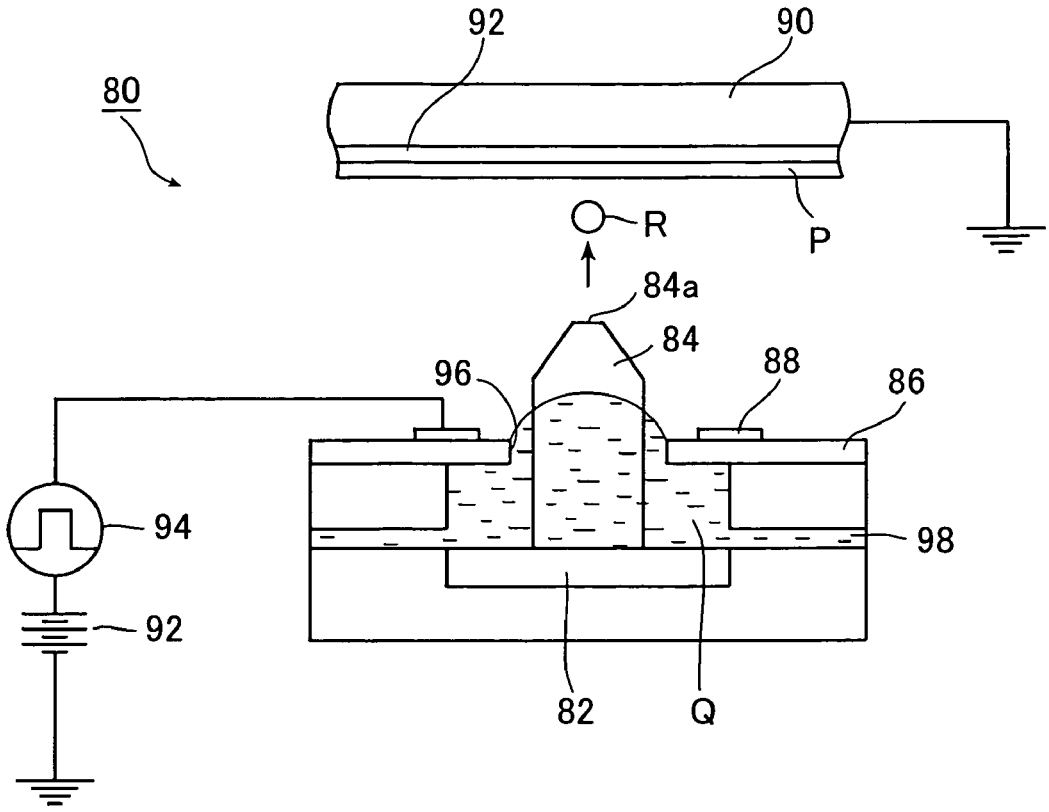
FIG. 4 is a conceptual view explaining a conventional electrostatic ink jet recording process.

When a finite time further elapses after start of the application of the pulse voltages, the balance obtained mainly between the charged color fine particles and the surface tension of the carrier liquid is broken at the tip portion of the meniscus having the high electric field strength applied thereto due to the movement of the charged color fine particles, or the like. As a result, the meniscus abruptly grows, and thus as conceptually shown in FIG. 3C, a slender ink liquid column, called the thread, having a diameter of about several microns to about several tens of microns.

When a finite time further elapses, the thread is divided into ink droplets due to the interaction resulting from the growth of the thread, the vibrations generated due to the Rayleigh/Weber instability, the ununiformity in distribution of the charged color fine particles within the meniscus, the ununiformity in distribution of the electrostatic field applied to the meniscus, and the like. The divided thread is then ejected and flied in the form of the ink droplets R and is drawn by the bias voltage as well to be stuck to the recording medium P.

The growth of the thread and the movement of the divided thread, and moreover the movement of the charged color fine particles to the meniscus and/or the thread are continuously generated while the pulse voltages are applied to the first and second control electrodes, respectively. In addition, at a time point when the application of the pulse voltages to the first and second control electrodes is completed (ejection is invalid), the state of the ink Q is returned back to the state of the meniscus shown in FIG. 3A in which only the bias voltage is applied to the recording medium P.

That is, according to the electrostatic ink jet recording process, one dot corresponding to one application of the pulse voltages to the first and second control electrodes (one ejection is valid) is formed by a plurality of fine ink droplets into which the thread is divided.

Consequently, a time period required to apply the pulse voltage once (the so-called pulse width) is made variable, and the variable time period is controlled to thereby adjust the quantity of ejection of the minute droplets (the number of minute droplets) which are obtained from one application of the pulse voltage, i.e., which form one dot. As a result, it is possible to realize the enhancement of uniformity of the dot diameters on the recording medium P, and the promotion of high gradation of the image recording based on the concentration gradation control utilizing the adjustment of the dot diameters.

Here, as apparent from the above description, the division frequency at which the thread is divided into the ink droplets, i.e., the ink droplet R is much higher than the drive frequency (the frequency at which the pulse voltage is applied to the control electrode) for the control electrode (the first control electrode 36 in the illustrated example).

In the present invention, when the drive frequency for the control electrode required to eject the ink droplet R is assigned A, and the division frequency required to divide the thread is assigned B, the ink droplet R is ejected under the condition in which a relationship of the division frequency B/the drive frequency A of equal to or higher than 5 kHz $\geqq 5$ is met so as to reduce the drive frequency B for the thread while the pulse voltage is applied once.

As described above, according to the electrostatic ink jet recording process, the control for the gradation in one dot, and the control for the dot diameters can be carried out by adjusting the pulse width. On the other hand, for the shadow area (high concentration area), the pulse width needs to be lengthened in order to eject the large quantity of ink droplet R. Hence, the controllability for the gradation and the dot diameters is forcedly reduced.

In addition, in the electrostatic ink jet recording process, as described above, the charged color fine particles are moved to the meniscus through the electrophoresis, i.e., the ink Q is concentrated in the meniscus to be ejected. Here, in the second half of the pulse voltage, the movement of the charged color fine particles to the meniscus and/or the thread is reduced due to reduction of the number of charged color fine particles, reduction of the electrostatic field strength resulting from that reduction, and the like. As a result, the concentration of the ink droplet R is reduced to cause the spread of an image.

On the other hand, in the ink jet recording method of the present invention, the drive frequency A is set equal to or higher than 5 kHz, and a ratio of the division frequency B for the thread to the drive frequency A is set equal to or larger than 5, i.e., the division frequency B is made 5 or more times as high as the drive frequency A. Thereby, the gradation resolution and the effect of dividing the thread into ink droplets are sufficiently ensured, and also the division frequency for the thread is reduced in one application of the pulse voltage (recording of one dot). For example, the electrostatic ink jet recording is carried out so that the division frequency which was 100 kHz at start of the division of the thread into ink droplets becomes 50 kHz at a time point of end of application of the pulse voltage.

As a result, in the present invention, even if the pulse width is lengthened in order to record the shadow area of an image, the controllability in the second half of the pulse voltage can be sufficiently ensured, and hence it is possible to enhance the gradation controllability and the gradation reproducibility for the shadow area of an image.

In addition, in the second half of the pulse voltage, the division frequency is reduced, i.e., the ejection interval is lengthened. Hence, after the sufficient quantity of charged color fine particles are moved to the tip portion of the meniscus, the thread can be divided into ink droplets (each of ink droplet R can be ejected). That is, according to the present invention, even in the second half of the pulse voltage, the ink droplet R which is suitably concentrated can be ejected. Hence, an image is prevented from spreading. This prevention results in that the controllability and reproducibility of the gradation can be enhanced.

Consequently, according to the present invention, in the electrostatic ink jet recording process, the electrical controllability for ejection of the ink droplets can be enhanced on the basis of the simple control for the pulse width made by an inexpensive drive circuit to realize the promotion of the high gradation and the uniformity of the dot diameters on the basis of the control for the pulse width. Also, the reproducibility and controllability of the gradation and the uniformity of the dot diameters in the shadow area can be enhanced to thereby record an image of high image quality.

In the electrostatic ink jet recording process, the various important matters exert influences on the division frequency for the thread.

Here, the results of the study made by the inventor of the present invention show that at least one of the electric field strength applied to the thread, the electric conductivity of the ink composition, and the quantity of supply of the ink is adjusted to thereby allow the division frequency for the thread of the ink to be suitably reduced in applying the pulse voltage once.

As a preferred example, when the electric field strength applied to the thread of the ink Q is preferably set to a range of $1\times10^5$ to $3\times10^7$ V/m, and is more preferably set to a range of $1\times10^6$ to $2.5\times10^7$ V/m, the division frequency for the thread can be suitably reduced. Note that the electric field strength applied to the thread has to be adjusted with the bias voltage or the pulse voltage for ejection of the ink droplet R, for example.

In addition, as another preferable example, even when the electric conductivity of the ink Q (ink composition) is preferably set to a range of 10 to 3,000 pS/cm, and more preferably set to a range of 100 to 2,000 pS/cm, the division frequency for the thread can be suitably reduced. The electric conductivity of the ink Q has to be adjusted on the basis of the quantity of addition of the charging control agent, or the like in preparing the ink Q, for example.

Moreover, as still another preferable example, even when the quantity of supply of the ink Q per nozzle (ejection portion) 48 is preferably set to a range of $1\times10^{-6}$ to $1\times10^{-3}$ cc/sec, and is more preferably set to a range of $5\times10^{-6}$ to $5\times10^{-4}$ cc/sec, the division frequency for the thread can be suitably reduced.

Consequently, in the electrostatic ink jet recording process, preferably, the ink Q having an electric conductivity of 10 to 3,000 pS/cm is used, the electric field strength applied to the thread is set to a range of $1\times10^{5}$ to $3\times10^{7}$ V/m, and the quantity of supply of the ink composition per nozzle 48 is set to a range of $1\times10^{-7}$ to $1\times10^{-3}$ cc/sec, whereby the division frequency for the thread can be suitably reduced while the pulse voltage is applied once to carry out the ink jet recording in which not only the controllability for the gradation and the dot diameters is excellent due to the division of the thread into ink droplets, but also the controllability and reproducibility of the gradation in the shadow area, and the controllability for the dot diameters in the shadow area are satisfactory.

It should be noted that in the present invention, a method including reducing the division frequency for the thread of the ink Q in applying the pulse voltage once is not limited to the above-mentioned examples. For example, there may also be utilized a method including reducing a voltage during the application of the pulse voltage, a method including, in the second half of the applied pulse voltage, applying vibrations each having a frequency lower than that in each of the vibrations in the first half of the applied pulse voltage, or the like.

In the present invention, there is not especially a limit to a degree of reduction of the division frequency for the thread in applying the pulse voltage once. Thus, if the division frequency is reduced, then an effect can be obtained to a certain extent. However, in order to stably and suitably obtain the effects of the present invention under the various conditions in which kinds of inks are different, apparatus constitutions are different, and so forth, the degree of reduction of the division frequency for the thread is preferably equal to or larger than 5%, and is more preferably equal to or larger than 25%, and is much more preferably equal to or larger than 40%. Note that this degree of reduction of the division frequency for the thread means how large a ratio of a difference in division frequency between start of the division of the thread and end of application of the pulse voltage in one application of the pulse voltage to the division frequency in start of the division is. For example, when the division frequency in start of the division of the thread is 100 kHz, and the division frequency in stop of application of the pulse voltage is 60 kHz, the degree of reduction is 40%.

In the present invention, the above-mentioned condition of "the division frequency B/the drive frequency A≧5" has to be met only in the beginning of the pulse voltage. Thus, there is not especially an upper limit to the degree of reduction of the division frequency as long as that condition is met.

In addition, in the ink jet recording method of the present invention, when image recording is carried out using a plurality of kinds of inks by the heads corresponding to the respective inks as in the color image recording using inks of cyan, magenta, yellow and black, it is preferable that the drawing be carried out, in a state where the division frequencies for the threads are harmonized among the respective inks, after the above-mentioned condition is met.

In addition, the drive frequency for the control electrode (the first control electrode 36 in this example) for ejection of the ink droplet R is preferably equal to or higher than 5 kHz, and is more preferably equal to or higher than 10 kHz. Setting of the drive frequency to the above-mentioned range is preferable, for example, in that an image of high image quality can be drawn, and the high speed drawing becomes possible.

Moreover, the ratio of the division frequency B to the drive frequency A is preferably equal to or larger than 5, and is more preferably equal to or larger than 7.5. Adoption of the above-mentioned range is preferable, for example, in that the gradation expression having improved controllability can be carried out.

The head 12 in the illustrated example has the first and second control electrodes 36 and 38. When the pulse voltages are applied to both the first and second control electrodes 36 and 38, respectively (both the first and second control electrodes 36 and 38 are driven), the above-mentioned Taylor cone and thread are formed, and the thread is divided into ink droplets. After that, each of ink droplets R is ejected after a short time lag from start of application of the pulse voltages to both the first and second control electrodes 36 and 38.

The second control electrodes 38 are set at a high voltage level (e.g., at 400 to 600 V) or in a high impedance state (in an ON state) in order one row by one row at a predetermined timing as described above. All the remaining second control electrodes 38 are driven at the ground level (the ground state, i.e., in an OFF state). On the other hand, the first control electrodes 36 are simultaneously driven in each of all columns at a high voltage level or at the ground level (ON state/OFF state) in correspondence to the image data. As a result, the ON/OFF ejection (ejection/non-ejection) of the ink in each of the ejection portions is controlled.

That is, when the second control electrode 38 is at the high voltage level or in the high impedance state, and also the first control electrode 36 is at a high voltage level, the ink Q is ejected in the form of the ink droplet R. When at least one of the first and second control electrodes 36 and 38 is at the ground level, no ink is ejected.

Then, the ink droplets R ejected from the respective ejection portions are attracted to the recording medium P charged at a negative high voltage to be stuck onto predetermined positions on the recording medium P to form an image.

Consequently, under those circumstances, the drive frequency for the control electrode for ejection of the ink droplet R becomes the drive frequency for the first control electrode 36 as described above.

As described above, when the rows of the second control electrodes 38 as the lower layer are successively turned ON, and the first control electrodes 36 as the upper layer are turned ON/OFF in correspondence to the image data, the first control electrodes 36 are driven in correspondence to the image data. Thus, when the individual ejection portions in the column direction are supposed to be the centers, in the ejection portions on both the sides of each central ejection portion, the levels of the first control electrodes 36 are changed frequently to the high voltage level or to the ground level. In this case, the guard electrode 40 is biased at a predetermined guard potential, e.g., at the ground level in recording an image, thereby excluding influences of electric fields of the adjacent ejection openings.

In addition, in the head 12 in the illustrated example, as another embodiment, the first and second control electrodes 36 and 38 can also be driven in opposite states. That is, the first control electrodes 36 can be successively driven one column by one column, and the second control electrodes 38 can be driven in correspondence to the image data.

In this case, with respect to the column direction, the first control electrodes 36 are driven one column by one column, and when the individual ejection portions in the column direction are supposed to be the centers, the first control electrodes 36 of the ejection portions on both the sides of each central ejection portion in the column direction usually become the ground level. Thus, the first control electrodes 36 of the ejection portions on both the sides of each central ejection portion in the column direction function as the guard electrode 40. In the case where the first control electrodes 36 as the upper layer are successively turned ON one column by one column, and the second control electrodes 38 as the lower layer are driven in correspondence to the image data, even if no guard electrode 40 is provided, the influences of the adjacent ejection portions can be excluded to enhance the recording quality.

In the head 12, whether the control for the ON/OFF of ink ejection is carried out using one of or both of the first control electrodes 36 and the second control electrodes 38 is not a limiting factor at all. That is, the voltages of the control electrode side and the recording medium P side only have to be suitably set so that when a difference between the voltage value of the control electrode side during the ON/OFF, and the voltage value of the recording medium P side is larger than a predetermined value, the ink is ejected, while when the difference is smaller than the predetermined value, no ink is ejected.

In any case, it is preferable to set the drive frequencies for the control electrodes, which are not successively driven but are pulse-modulation-driven in correspondence to the image data, to be equal or higher than 5 kHz.

In addition, while in this aspect, the color fine particles in the ink are positively charged, and the recording medium P side is charged at a negative high voltage, the present invention is not limited thereto. That is, conversely, the color fine particles in the ink may be negatively charged, and the recording medium P side may be charged at a positive high voltage. In such a manner, when the polarity of the color fine particles is reversed to that of the color fine particles in each of the above-mentioned embodiments, the polarities or the like of the applied voltages to the charging unit 16 for the recording medium P, and the first and second control electrodes 36 and 38 of each of the ejection portions only have to be reversed to those in each of the above-mentioned embodiments.

While the ink jet recording method of the present invention has been described above in detail, it is to be understood that the present invention is not limited to the above-mentioned embodiments. Hence various improvements and changes may be made without departing from the gist of the present invention.

EXAMPLE 1

The present invention will hereinafter be described in more detail by giving a concrete example of the present invention.

The degree of reduction in division frequency for the thread in one application of the pulse voltage was changed as shown in Table 1 using the recording apparatus shown in FIGS. 1A and 1B, and the gradation reproducibility and the uniformity of the dots in the shadow portion were observed for the respective cases.

Note that the degree of reduction in division frequency for the thread was changed by changing the electric field strength applied to the thread, the drive frequency for the control electrode for ejection of the ink droplet R (the drive frequency for the first control electrode 36), the pulse duty ratio, the electric conductivity of the ink Q, and the quantity of supply of the ink Q per nozzle 48. The ink droplet R was ejected under the completely same conditions except that those factors are changed.

The gradation reproducibility of the shadow portion, and the uniformity of the dot diameters were evaluated as follows. Table 1 shows the ejection conditions, the degree of reduction in division frequency of the thread, and the evaluation results.

[Gradation Reproducibility of Shadow Portion]

In the electrostatic ink jet recording process based on the pulse voltage driving using the recording apparatus 10 shown in FIGS. 1A and 1B, the pulse width modulation of 256 gradations was carried out every example and comparative example, and a step wedge pattern having steps of 256 gradations was recorded on fine coat paper for printing.

The concentration of the step wedge pattern was measured with an optical densitometer of an X-RITE508 type (manufactured by X-RITE CO., LTD.) to detect the number of step wedges (the number of gradations) in which changes could be observed in an area having a concentration of equal to or larger than 0.8.

In Table 1;

◎: an image in which 16 or more gradations can be observed.

○: an image in which 12 or more gradations can be observed.

Δ: an image in which the number of gradations able to be observed is 5 to 11.

x: an image in which the number of gradations able to be observed is equal to or smaller than 4.

[Uniformity of Dot Diameters]

In the electrostatic ink jet recording process based on the pulse voltage driving using the recording apparatus 10 shown in FIGS. 1A and 1B, a large number of dots were formed so as not to overlap one another every example and comparative example. The circle equivalent diameters were measured with respect to an area having a concentration of equal to or larger than 0.3 having 1,000 dots which were selected at random using a dot analyzer of a DA-6000 type (manufactured by OJI SCIENTIFIC INSTRUMENTS CO., LTD.) to calculate a standard deviation (a). Then, the uniformity of the dot diameters was evaluated with a value of 3σ.

◎: 3σ is equal to or smaller than 2%.

○: 3σ is equal to or smaller than 5%.

Δ: 3σ is equal to or smaller than 10%.

x: 3σ is equal to or smaller than 15%.

xx: 3σ exceeds 15%.

TABLE 1

| | Example 1 | Example 2 | Example 3 | Comparative Example 1 | Comparative Example 2 | Comparative Example 3 | Comparative Example 4 | Comparative Example 5 |
|---|---|---|---|---|---|---|---|---|
| Electric field strength [V/m] | $1 \times 10^7$ | $1 \times 10^7$ | $2.5 \times 10^7$ | $1 \times 10^7$ | $1 \times 10^7$ | $1 \times 10^7$ | $1 \times 10^7$ | $1 \times 10^7$ |
| Drive frequency [kHz] | 15 | 5 | 20 | 15 | 15 | 15 | 15 | 15 |
| Pulse duty ratio [%] | 70 | 70 | 65 | 70 | 70 | 70 | 70 | 70 |
| Electric conductivity of ink [ps/cm] | 1,000 | 1,000 | 800 | 1,000 | 4,000 | 5 | 1,000 | 1,000 |
| Quantity of supply of ink per nozzle [cc/sec] | $6 \times 10^{-4}$ | $1 \times 10^{-4}$ | $7 \times 10^{-4}$ | $6 \times 10^{-4}$ | $6 \times 10^{-4}$ | $6 \times 10^{-4}$ | $1 \times 10^{-2}$ | $3 \times 10^{-7}$ |
| Degree of reduction in division frequency [%] | 15 | 25 | 40 | 0 | 0 | 0 | 0 | 0 |
| Gradation reproducibility of shadow portion | ○ | ◎ | ◎ | Δ | x | Δ | Δ | No image can be stably drawn |
| Uniformity of dot diameters | ○ | ○ | ◎ | Δ | xx | x | Δ | |

As shown in Table 1, according to the present invention in which the division frequency for the thread in one application of the pulse voltage is reduced to eject the ink droplet, the recording, of an image of high image quality, in which the gradation reproducibility and the uniformity of dot diameters in the shadow portion are both excellent can be carried out through the ink jet recording process for ejecting the ink droplet using the electrostatic force.

In particular, the degree of reduction in division frequency for the thread is set equal or larger than 25% to thereby allow the improved gradation reproducibility of the shadow portion to be realized. Above all things, the degree of reduction in division frequency for the thread is set equal to or larger than 40%, whereby it is possible to carry out the image recording in which the gradation reproducibility and the uniformity of dot diameters in the shadow portion are both excellent.

From the above results, the effects of the present invention are obvious.

What is claimed is:

1. An ink jet recording method comprising the steps of:

causing an electrostatic force to act on ink composition obtained by dispersing charged particles containing colorants in a dispersion medium;

generating a thread of said ink composition on a nozzle; and dividing said thread into ink droplets to eject said ink droplets of said composition through said nozzle; wherein a relationship of A≧5 kHz and B/A≧5 is met when a drive frequency for an electrode used to cause said electrostatic force to act on said ink composition is assigned A, and a division frequency for said thread is assigned B; and said division frequency for said thread is reduced for a time period to apply a pulse voltage to said electrode to eject the ink composition.

2. The ink jet recording method according to claim 1, wherein said ink composition having electric conductivity of 10 to 3,000 pS/cm is used to reduce said division frequency.

3. The ink jet recording method according to claim 1, wherein electric field having strength of $1\times10^5$ to $3\times10^7$ V/m is applied to said electrode for said time period required to apply said pulse voltage to reduce said division frequency.

4. The ink jet recording method according to claim 1, wherein said ink composition is supplied to said nozzle at a rate of $1\times10^{-6}$ to $1\times10^{-3}$ cc/sec to reduce said division frequency.

5. The ink jet recording method according to claim 1, wherein the time period required to apply said pulse voltage to said electrode is controlled so as to adjust a quantity of ejection of said ink droplets of said ink composition in forming one dot on a recording medium.

6. The ink jet recording method according to claim 1, wherein a degree of reduction in said division frequency for said time period required to apply said pulse voltage to said electrode is equal to or larger than 5%.

7. An ink jet recording method comprising the steps of:

causing an electrostatic force to act on ink composition obtained by dispersing charged particles containing colorants in a dispersion medium;

generating a thread of said ink composition on a nozzle; and dividing said thread into ink droplets to eject said ink droplets of said composition through said nozzle; wherein said ink composition having an electric conductivity of 10 to 3,000 pS/cm is used;

electric field having strength of $1\times10^5$ to $3\times10^7$ V/m is applied to said thread; and said ink composition is supplied to said nozzle at a rate of $1\times10^{-6}$ to 1×10−3 cc/sec.

8. The ink jet recording method according to claim 7, wherein a pulse voltage is applied to an electrode used to cause said electrostatic force to act on the ink, a division frequency for said thread is reduced for a time period required to apply said pulse voltage to said electrode.

9. The ink jet recording method according to claim 8, wherein said time period required to apply said pulse voltage to said electrode is controlled so as to adjust a quantity of ejection of said ink droplets of said ink composition in forming one dot on a recording medium.

10. The ink jet recording method according to claim 8, wherein a degree of reduction in said division frequency for said time period required to apply said pulse voltage to the electrode is equal to or larger than 5%.

* * * * *

UNITED STATES PATENT AND TRADEMARK OFFICE

CERTIFICATE OF CORRECTION

PATENT NO. : 7,118,196 B2
APPLICATION NO. : 10/921893
DATED : October 10, 2006
INVENTOR(S) : Keitaro Aoshima It is certified that error appears in the above-identified patent and that said Letters Patent is hereby corrected as shown below:

Col. 20 line 59, "1x10-3" should read as: --$1x10^{-3}$--

Signed and Sealed this

Twenty-sixth Day of June, 2007

JON W. DUDAS
*Director of the United States Patent and Trademark Office*